US010357802B2

(12) United States Patent
Lunnemann et al.

(10) Patent No.: US 10,357,802 B2
(45) Date of Patent: Jul. 23, 2019

(54) SEPARATOR LIFTING APPARATUS AND METHOD

(71) Applicant: M-I L.L.C., Houston, TX (US)

(72) Inventors: Robert A. Lunnemann, Florence, KY (US); Bradley N. Jones, Crestview Hills, KY (US); Marc D. Mayer, Hamilton, OH (US)

(73) Assignee: M-I L.L.C., Houston, TX (US)

( * ) Notice: Subject to any disclaimer, the term of this patent is extended or adjusted under 35 U.S.C. 154(b) by 34 days.

(21) Appl. No.: 15/316,189

(22) PCT Filed: Jun. 4, 2015

(86) PCT No.: PCT/US2015/034093
§ 371 (c)(1),
(2) Date: Dec. 5, 2016

(87) PCT Pub. No.: WO2015/187898
PCT Pub. Date: Dec. 10, 2015

(65) Prior Publication Data

US 2017/0320095 A1 Nov. 9, 2017

Related U.S. Application Data

(60) Provisional application No. 62/009,006, filed on Jun. 6, 2014.

(51) Int. Cl.
*B07B 1/28* (2006.01)
*B07B 1/46* (2006.01)

(52) U.S. Cl.
CPC ..... *B07B 1/284* (2013.01); *B07B 1/28* (2013.01); *B07B 1/4618* (2013.01); *B07B 2201/02* (2013.01); *B07B 2201/04* (2013.01)

(58) Field of Classification Search
CPC ..... B07B 1/46; B07B 1/284; B07B 1/4618; B07B 2201/02; B07B 2201/04
(Continued)

(56) References Cited

U.S. PATENT DOCUMENTS 4,477,343 A 10/1984 Tucker
4,582,597 A 4/1986 Huber
(Continued)

FOREIGN PATENT DOCUMENTS

DE 10259018 A1 1/2004
DE 202011106796 U1 1/2012
EP 1121987 A1 8/2001

OTHER PUBLICATIONS

International Preliminary Report on Patentability for the equivalent International patent application PCT/US2015/034093 dated Dec. 15, 2016.
(Continued)

*Primary Examiner* — Joseph C Rodriguez
*Assistant Examiner* — Kalyanavenkateshware Kumar
(74) *Attorney, Agent, or Firm* — David J. Smith

(57) ABSTRACT

An apparatus includes a vibratory separator having a frame and a screen, a lift housing disposed proximate the vibratory separator, and a lift system disposed in the lift housing and configured to selectively engage a portion of the vibratory separator to lift the portion of the vibratory separator. A method includes actuating an actuator and vertically extending a lifting member, contacting an alignment device coupled to the lifting member with a corresponding alignment device coupled to a portion of a vibratory separator, and raising the portion of the vibratory separator to provide access to a screen of the vibratory separator.

17 Claims, 4 Drawing Sheets

(58) Field of Classification Search
USPC ..... 209/319, 363, 370, 372, 373, 399, 404, 209/405, 408, 409, 412, 413
See application file for complete search history.

(56) References Cited

U.S. PATENT DOCUMENTS

| | | | |
|---|---|---|---|
| 5,232,098 | A | 8/1993 | St-Pierre et al. |
| 6,698,593 | B1 | 3/2004 | Folke et al. |
| 8,631,945 | B1 | 1/2014 | Cato |
| 2003/0019799 | A1 | 1/2003 | Masukane et al. |
| 2007/0084762 | A1 | 4/2007 | Mainwaring et al. |
| 2010/0018909 | A1 | 1/2010 | Smith |

OTHER PUBLICATIONS

Extended Search Report for the equivalent European patent application 15802576.7 dated Jan. 19, 2018.
International Search Report & Written Opinion regarding corresponding application No. PCT/US21015/034093; dated Aug. 31, 2015; 10 pages.

SEPARATOR LIFTING APPARATUS AND METHOD

CROSS REFERENCE TO RELATED APPLICATIONS

This application is a National Stage application of International Application No. PCT/US2015/034093 filed Jun. 4, 2015, which claims the benefit of U.S. Provisional Application having Ser. No. 62/009,006 filed on Jun. 6, 2014, which is incorporated by reference in its entirety.

BACKGROUND

Vibratory separators are used to separate solid particulates of different sizes and/or to separate solid particulate from fluids. Vibratory separators may be used in various industries or for various applications, including, for example, the food industry, the cleaning industry, the oil and gas industry, and waste water treatment. Vibratory separators include one or more screens or screening decks. The screens may include a mesh of a determined size that defines the size of the openings in the mesh. Thus, a screen may be selected with a determined size based on the size of the particles to be removed from a material.

The screen is mounted horizontally or at an angle with respect to a horizontal plane and coupled to a vibratory mechanism (e.g., an unbalanced weight on a rotating shaft coupled to the vibratory separator) to impart a desired vibrational motion to the screen. One or more springs may be coupled to the vibratory separator to allow the screen of the vibratory separator to be vibrated. Material that is to be separated or filtered is deposited on to the screen and the screen is vibrated. Fluid and particles smaller than the mesh size of the screen passes through the screen, while material larger than the mesh size of the screen remains on the screen.

Flow of fluid through and/or across a screen may cause the screen mesh to wear or erode. Thus, the screen(s) of a vibratory separator may be removed and replaced with a new screen one or more times during the life of the vibratory separator.

DETAILED DESCRIPTION

In one aspect, embodiments disclosed herein relate to a vibratory separator and a lifting assembly for lift at least a portion of the vibratory separator. In particular, embodiments disclosed herein relate to a lifting assembly independent from a vibratory separator that is configured to lift a portion of the vibratory separator to provide access to one or more screens or components of the vibratory separator. For example, a lifting assembly in accordance with embodiments disclosed herein lifts a portion of the vibratory separator so that a worn or damage screen may be removed and replaced. The lifting assembly is configured to lower the portion of the vibratory separator in a controlled manner so that the vibratory separator may be reassembled.

A lifting assembly in accordance with embodiments disclosed herein may include a lift housing disposed proximate to and independent from the vibratory separator. The lifting assembly may include an alignment device configured to engage and align a lifting member of the lifting assembly with a portion of the vibratory separator.

In accordance with one or more embodiments of the present disclosure, a lifting assembly may include one or more safety features to ensure the vibratory separator is not in operation during a lifting operation. For example, a lifting assembly in accordance with embodiment disclosed herein may include one or more sensors configured to sense a position of at least one component of the lifting assembly. Such sensors may then signal when the lifting assembly has been actuated and signal the vibratory separator to shut down. In some embodiments, a lifting assembly may include an actuator for providing lift to a lifting member of the lifting assembly. In such an embodiment, a piloted check valve may be coupled to the lifting assembly to maintain a set lift of the lifting assembly in the event that the lift assembly loses pressure.

Figure 1:
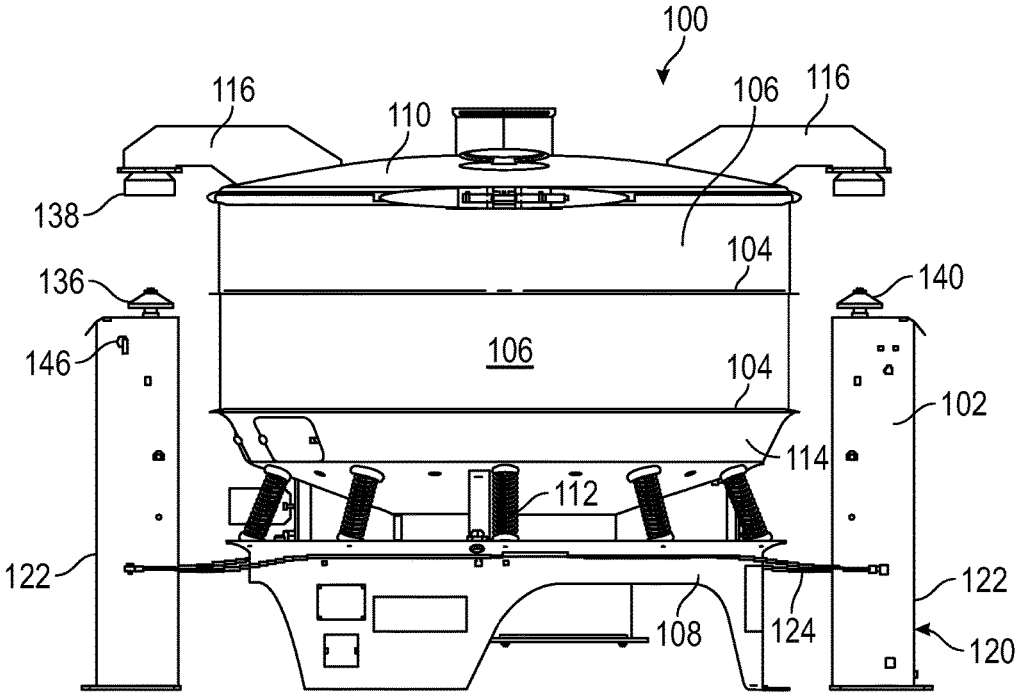
FIG. 1 is a perspective view of a vibratory separator and a lifting assembly in accordance with embodiments disclosed herein.

FIG. 1 shows a vibratory separator 100 and a lifting assembly 102 in accordance with embodiments disclosed herein. Vibratory separator 100 may be any vibratory separator known in the art including, for example, industrial separators, shale shakers, stacked sieves, etc. Further, one of ordinary skill in the art will appreciate that the vibratory separator and one or more screens disposed therein may be round, square, rectangular, or any other shape known in the art. In other words, embodiments of the present application are not limited to specific types of vibratory separators. Vibratory separator 100 may include one or more screens 104. The screens 104 may be disposed one above the other in a stacked configuration. Each screen 104 may be coupled to a screen frame 106 or a screen deck. Thus, each screen frame 106 or screen deck may also be disposed one above the other in a stacked configuration. Each screen frame 106 or screen deck is independent from a second or subsequent screen frame 106 such that the screen frames may be separated to provide access to the screens disposed therein. A band clamp (not shown) or other mechanical fastener may be used to couple the screen frames 106 to each other during operation of the vibratory separator.

The vibratory separator 100 includes a base 108 and in some embodiments may include a top portion 110. One or more springs 112 may be coupled between a lower portion 114 of the vibratory separator 100 and the base 108 to allow for vibrational movement of the vibratory separator. The vibratory separator 100 includes a vibration mechanism (e.g., an unbalanced weight on a rotating shaft coupled to the vibratory separator) to impart a desired vibrational motion to the screen 104. Any vibration mechanism known in the art may be included with the vibratory separator 100 to impart vibrational motion to the screen 104.

Figure 2:
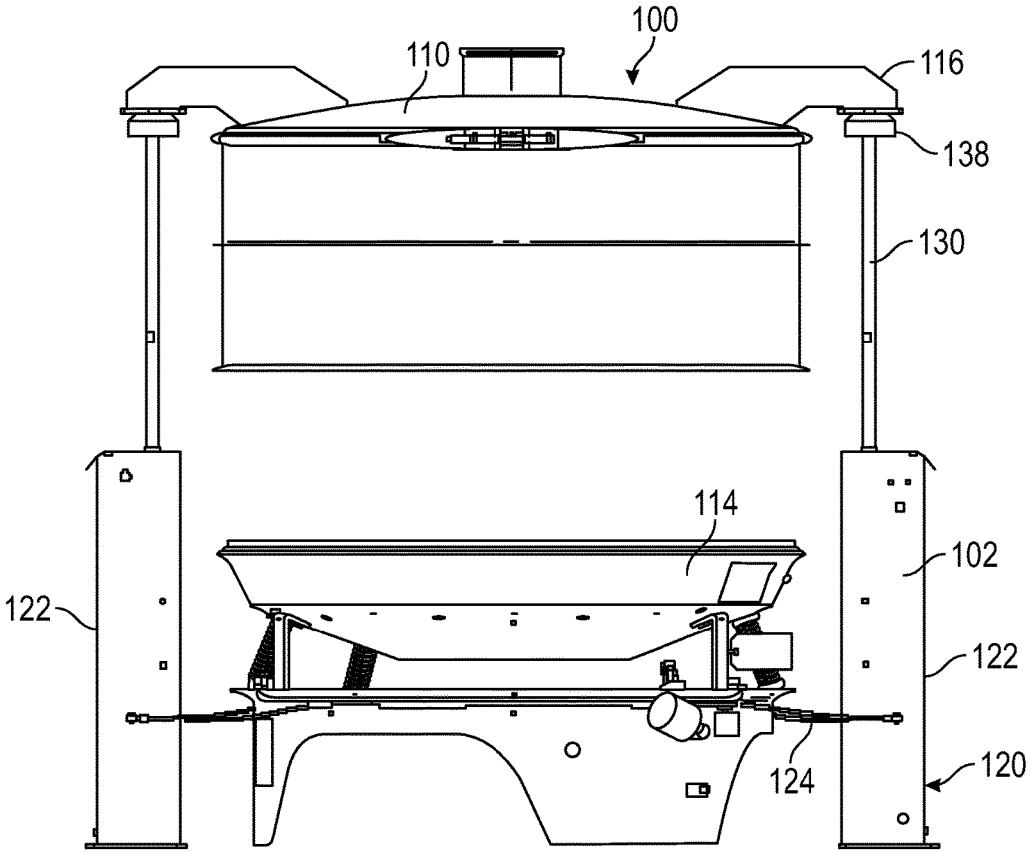
FIG. 2 is a perspective view of the vibratory separator and lifting assembly of FIG. 1 with the vibratory separator in a lifted position in accordance with embodiments disclosed herein.

The vibratory separator 100 may further include a bracket 116 coupled to a portion of the vibratory separator 100. As shown in FIG. 1, for example, the bracket 116 may be coupled to the top portion 110 of the vibratory separator. The bracket 116 may extend radially outward from the vibratory separator such that at least a portion of the bracket extends outside an outer perimeter of the screen frame 106 of the vibratory separator. The bracket 116 is configured to receive a lifting member of a lifting assembly, as discussed in more detail below. Bracket 116 may be coupled to the top portion 110 or any other portion of the vibratory separator 100 (e.g., a side wall, a screen frame, etc.) by any means known in the art, for example, welding, mechanical fasteners, etc. or the bracket 116 may be integrally formed with the top portion 110 or any other portion of the vibratory separator. Although a bracket 116 is referenced herein, one of ordinary skill in the art will appreciate that other devices or components may be used as a lifting member receiving surface instead of a bracket. In other words, the vibratory separator 100 may include at least one lifting member receiving surface configured to receiving a lifting member of the lifting assembly 102 (as shown in FIG. 2). For example, the lifting member receiving surface may be coupled to or formed in top portion 110 or any other portion of the vibratory separator 100. Examples of a lifting member receiving surface may include a lifting pad or hook, an arm or extension portion, or a groove or slot formed in an outer surface of the top portion 100 or any other portion of the vibratory separator 100. One of ordinary skill in the art will appreciate that the vibratory separator 100 may include more than one lifting member receiving surface (e.g., bracket 116, lifting pad, extension portion, etc.). The lifting member receiving surfaces may be disposed at various locations around the vibratory separator 100 and the present disclosure is not limited to the locations shown or described with reference to FIG. 1. For example, the lifting member receiving surfaces may be spaced equally azimuthally around the vibratory separator 100 or may be disposed at corners of the vibratory separator 100.

Lifting assembly 102 includes a lifting housing 120. The lifting housing 120 is independent from the vibratory separator 100. In other words, the lifting housing 120 is not directly coupled to or supported by the vibratory separator 100. The lifting housing 120 may be disposed proximate to the vibratory separator 100. For example, as shown in FIG. 1, the lifting housing 120 may be disposed next to the vibratory separator. The lifting housing 120 may be secured to the floor by, for example, bolting or otherwise mechanically fastening. The lifting housing 120 is configured to house and support a lift system, described in more detail below, of the listing assembly. In some embodiments, the lifting housing 120 may include two or more legs 122 or structures, each configured to house and support a lift system. The legs 122 or structures may be disposed as various locations around the vibratory separator 100 and the present disclosure is not limited to the locations shown or described with reference to FIG. 1. For example, the legs 122 or structures may be spaced equally azimuthally around the vibratory separator 100 or may be disposed at corners of the vibratory separator 100. In some embodiments, the number and location of legs 122 may correspond to the number and location of the lifting member receiving surfaces of the vibratory separator 100.

The lift systems housed in each of the legs 122 or structures of the lifting housing 120 may be independently actuated or may be coupled together to provide concurrent actuation. For example, as shown in FIG. 1, the lift systems may be coupled with a pneumatic air line 124 to provide concurrent actuation in embodiments where the lift systems include a pneumatic actuator.

Figure 3:
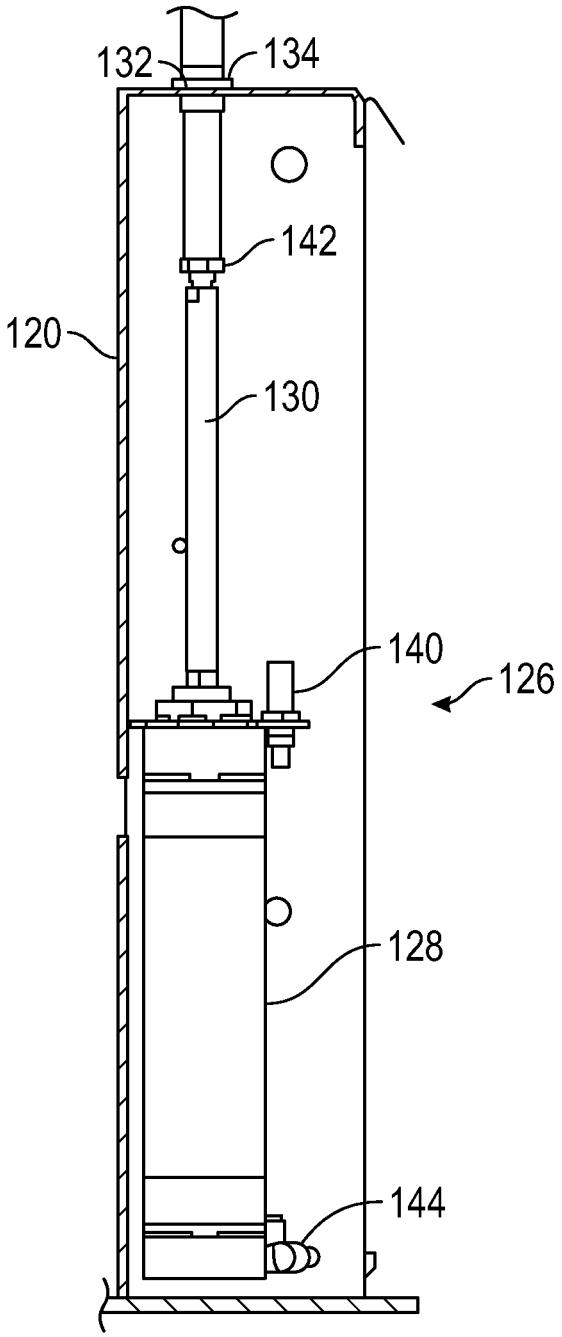
FIG. 3 is a detailed view of a lifting assembly in accordance with embodiments disclosed herein.

Referring now to FIG. 3, one or more lifting housings 120 of the lifting assembly 102 may include a lift system 126. The lift system 126 may include an actuator 128 and a lifting member 130. The actuator 128 may be any actuator known in the art. The actuator 128 may be a linear actuator, for example, a motorized linear actuator, a hydraulic cylinder actuator, or a magnetic force actuator. The lifting member 130 is coupled to the actuator 128 and is configured to sliding extend from the lift system 126 when actuated. The lifting member 130 may be a rod, for example, a stainless steel or carbon steel rod. The lifting member 130 is configured to slidingly extend from the actuator 128 into engagement with a lifting member receiving surface, e.g., bracket 116 (FIG. 1) of the vibratory separator 100 to thereby lift a portion of the vibratory separator 100. A switch 146 (FIG. 1) may be provided, for example on the lifting housing 120, to activate the actuator 128. The switch 146 may include various positions so that the actuator 128 may be toggled between an off position, an up position, and a down position.

Figure 4:
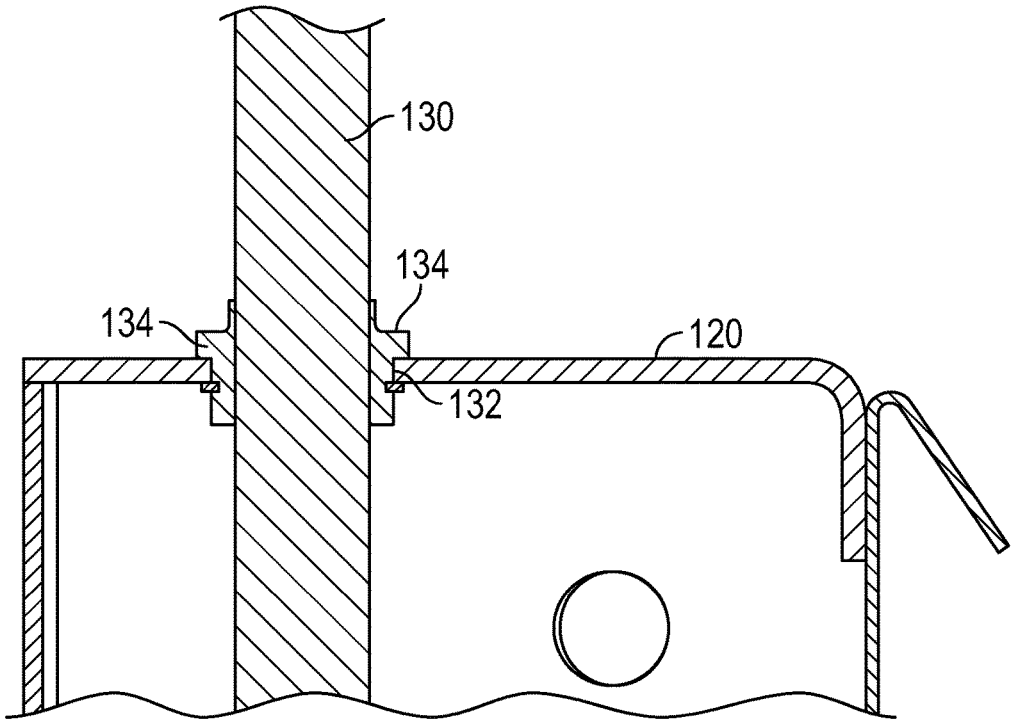
FIG. 4 is a detailed view of engagement of a lifting member with a lifting housing of lifting assembly in accordance with embodiments disclosed herein.

The lifting member 130 is configured to extend through an opening 132 in an upper portion of the lifting housing 120. As shown in FIG. 4, a bearing seal 134 may be disposed within the opening 132 in the lifting housing 120 and configured to slidingly engage the lifting member 130. Specifically, as the lifting member 130 is actuated by the actuator 128, the lifting member 130 may move or reciprocate within the bearing seal 134 so that the lifting member 130 may extend through the lifting housing 120 and into contact with the lifting member receiving surface, e.g., bracket 116. The bearing seal 134 is configured to allow the lifting member 130 to slidingly reciprocate through the lifting housing 120 while providing a seal between the lifting member 130 and the lifting housing 120, thereby reducing or preventing ingress of debris or materials being filtered into the lifting housing 120. The bearing seal 134 may have various geometries and may be formed from any material known in the art. For example, as shown in FIG. 4, the bearing seal 134 may include body having a throughbore have a cross-section (e.g., circular, square, etc.) that corresponds to the cross-section (e.g., circular, square, etc.) of the lifting member 130. Examples of materials of which the bearing seal 134 may be formed include bronze, plastic, metal, thermoplastic polyethylene, such as ultra-high-molecular weight polyethylene, etc. An outer surface of the bearing seal 134 may include multiple different diameters, such that a first portion has an outer diameter larger than a diameter of the opening 132. For example, as shown in FIG. 4, the bearing seal 134 may include a first portion having an outer diameter 136 disposed above the opening 132 that is larger than the diameter of the opening 132 to prevent ingress of debris or material into the lifting housing 120. In other embodiments, the bearing seal 134 may include a first portion having an outer diameter 136 disposed below the opening 132 that is larger than the diameter of the opening 132. In yet other embodiments, the bearing seal 134 may include a first portion having an outer diameter larger than the diameter of the opening 132 disposed above the opening 132 and a second portion having an outer diameter larger than the diameter of the opening 132 below the opening 132, while a middle portion of the bearing seal 134 has an outer diameter approximately equal to or less than the diameter of the opening 132.

Referring again to FIG. 1, an alignment device 136 may be coupled to the lifting assembly 102 to facilitate alignment of the lifting assembly 120 and the vibratory separator 100. The alignment device 136 may be a separate component coupled to an upper end of the lifting member 130 (FIGS. 2, 3) or may be integrally formed onto an upper end of the lifting member 130 (FIGS. 2, 3). A corresponding alignment device 138 may be coupled to the lifting member receiving surface (e.g., bracket 116) of the vibratory separator 100. Although only one alignment device 136 and one corresponding alignment device 138 are described here with respect to the lifting member 130 and the lifting member receiving surface (e.g., bracket 116), one of ordinary skill in the art will appreciate that each lifting member receiving surface or each lifting member 130 of the lifting assembly 102 may include an alignment device 136 or corresponding alignment device 138 and that various combinations of the alignment devices 136 and corresponding alignment devices 138 described herein may be used in accordance with one or more embodiments of the present disclosure.

The alignment device 136 may include a profile configured to correspond to a profile of the corresponding alignment device 138 to facilitate alignment of the alignment device 136 and corresponding alignment device 138, thereby aligning the vibratory separator 100 with the lifting assembly 102. For example, the profile of the alignment device 136 and/or the profile of the corresponding alignment device 138 may be conical, frustoconical, tapered, or radiused/curved. The alignment device 136 and the corresponding alignment device 138 may be formed from any material known in the art, for example, plastic, metal, thermoplastic polyethylene, such as ultra-high-molecular weight polyethylene, etc.

The lifting assembly 102 may also include one or more safety features to ensure the vibratory separator is not in operation during a lifting operation, to terminate operation of the vibratory separator 100 when the lift system 126 is actuated, or to ensure the vibration mechanism of the vibratory separator 100 may not be started when the lift system 126 is in operation. For example, the lifting assembly 102 may include one or more sensors 140. The sensor 140 may be a proximity sensor configured to detect when the lift system 126 is in use and send a signal to the vibration mechanism (not shown) to stop vibration of the vibratory separator 100 or to prevent actuation of the vibration mechanism.

In one embodiment, the sensor 140 may be disposed on an upper end of the lifting member 130. Sensor 140 may be any sensor configured to detect proximity of an object or a location of an object, for example, a proximity switch, a hall effect sensor, or an ultrasonic sensor. As shown in FIG. 1, in some embodiments the sensor 140 may be disposed on the alignment device 136. Thus, if an object becomes close to the lifting member 130, for example, as the lifting member 130 is moved into engagement with the lifting member receiving surface (e.g., into engagement with the corresponding alignment device 138 disposed on bracket 116), the sensor 140 senses the proximity of the object and sends a signal to the vibratory separator (vibration mechanism). One of ordinary skill in the art will appreciate that the sensor may be operatively coupled to an electronic control module or a computer that is operatively coupled to the vibration mechanism. Thus, when the sensor 140 detects that an object is near, the vibration mechanism of the vibratory separator 100 may be automatically turned off or operation of the vibration mechanism may be restricted. In other words, when the lifting assembly 102, and specifically, the lifting member 130 is in operation, use of the vibration mechanism is restricted or limited. In other embodiments, the sensor may send the signal to the electronic control module or the computer for displaying the position of the lifting member 130 to the user, so that the user can then determine whether to operate the vibration mechanism of the vibratory separator.

In some embodiments, the sensor 140 maybe be disposed on an upper end of the actuator 128, as shown in FIG. 3. In this embodiment, a sensor bracket 142 or corresponding sensor component may be coupled to the lifting member 130. The sensor 140 coupled to the actuator 128 is configured to sense when the sensor bracket 132 on the lifting member 130 is near. When the sensor bracket 132 is moved away from the sensor 140 on the actuator 128, the sensor 140 will send a signal which indicates that the lifting assembly 102 is in operation, thereby signaling restriction of use of the vibration mechanism. Although this embodiment is described with the sensor 140 disposed on the actuator 128 and the sensor bracket 142 on the lifting member 130, one of ordinary skill in the art will appreciate that the sensor 140 may be disposed on the lifting member 130 and the sensor bracket disposed on the actuator 128.

In another embodiment, the sensor 140 may be disposed on the actuator 128 and configured to sense movement of a piston (not shown) of the actuator 128. For example, if the actuator 128 is a hydraulic or air cylinder, the cylinder may include a magnetic piston. In this example, when the magnetic piston moves to extend or lift the lifting member 130, the sensor 140 senses the movement of the magnetic piston (not shown) and sends a signal so that operation of the vibration mechanism is restricted or limited. In this example, the sensor 140 may be disposed proximate a lower end of the actuator 140 or proximate a piloted check valve 144 (FIG. 3).

The piloted check valve 144 may be coupled to the actuator 128 and provide an additional safety feature for the lifting assembly 102. For example, in the even the lift system 126 loses pressure, e.g., air pressure, the piloted check valve may prevent the system from failing. The piloted check valve allows pressure to be applied in one direction, but can be opened by an external pilot pressure in the event of pressure loss.

A method of lifting a portion of a vibratory separator 100 with a lifting assembly 102 is now described with respect to FIGS. 1-4. The lifting assembly 102 is installed proximate and/or around the vibratory separator 100. The lifting housings 120 are positioned approximately below the lifting member receiving surface (e.g., bracket 116). One or more locking mechanisms coupled to the vibratory separator 100 or to the screen frames 106 may be unlocked or removed to allow a determined portion of the vibratory separator 100 to be lifted from a remaining portion of the vibratory separator 100. For example, as shown in FIG. 2, the top portion 110 and two screen frames 106 may be lifted from the lower portion 114 of the vibratory separator 100. In some embodiments, a band clamp may be released which locks two screen frames 106 together, such that one screen frame may be lifted from the other screen frame stacked below. Lifting of a portion of the vibratory separator 100 may provide access to a screen 104 disposed therein.

The actuator 128 is actuated to vertically extend the lifting member 130 through the lifting housing 120 and into contact with the lifting member receiving surface. For example, as shown in FIG. 2, the corresponding alignment device 138 receives the alignment device 136 (FIG. 1) when the lifting member 130 is extended. In FIG. 2, the alignment device 136 is not shown, as it is disposed inside the corresponding alignment device 138. In this example, as the alignment device 136 is moved into engagement with the corresponding alignment device 138, the conical surface of the alignment device 136 contacts the frustoconical surface of the corresponding alignment device 138 to facilitate alignment of the vibratory separator 100 with the lifting assembly 102, and particularly the lifting members 130. As the alignment device 136 and corresponding alignment device 138 are engaged, the lifting member 130 continues to raise or extend vertically from the actuator 128, thereby raising or lifting the portion of the vibratory separator 100. A clearance may be provided between the lifted portion of the vibratory separator 100 and the portion of the vibratory separator 100 that remains stationary. The clearance height may be determined by limits on the actuator 128 and the lifting member 130 (e.g., length of lifting member 130), or the clearance height may be selected by the user. For example, the clearance between a frame 106 and a screen 104 may be 4 inches, 6 inches, 10 inches, or any clearance selected for a particular application. The clearance is provided so that the screen 104 may be accessed for cleaning or removal of the screen 104. The screen 104 may be replace with a new screen and the actuator 128 actuated to lower the lifting member 130, thereby lowering the portion raised of the vibratory separator 100. The portion raised of the vibratory separator 100 may be locked or coupled back to the stationary part of the vibratory separator 100, and the vibratory separator may be run.

When the actuator 128 is actuated and the lifting member 130 is raised, a sensor 140 may signal operation of the lifting assembly 102. For example, as the lifting member 130 is raised, sensor 140 (FIG. 1) disposed on the alignment device 136 may signal use of the lifting assembly 102 when the alignment device 136 moves close to the corresponding alignment device 138. In other embodiments, as shown in FIG. 2, as the lifting member 130 is raise, sensor 140 may signal operation of the lifting assembly 102 when the sensor bracket 142 moves out of proximity to the sensor 140. In yet other embodiments, a sensor (not shown) may signal operation of the lifting assembly 102 when it senses movement of the piston of the actuator 128. Thus, the sensor 140 may provide a signal to indicate that the lifting assembly 102 is in operation or to indicate that the lifting assembly 102 is not in operation. When the sensor 140 senses that the lifting assembly 102 is in operation, a signal may be sent to the electronic control module (not shown) or computer (not shown) to automatically turn off or restrict operation of the vibration mechanism of the vibratory separator or to signal a user that the lifting assembly 102 is in operation so that the user can determine whether to stop or not operate the vibratory separator.

Although the preceding description has been described herein with reference to particular means, materials and embodiments, it is not intended to be limited to the particulars disclosed herein. Rather, it extends to all functionally equivalent structures, methods and uses, such as are within the scope of the appended claims.

What is claimed:

1. An apparatus comprising:

a vibratory separator having a frame and a screen;

a lift housing disposed proximate the vibratory separator;

a lift system disposed in the lift housing and configured to selectively engage a portion of the vibratory separator to lift the portion of the vibratory separator; and an alignment device coupled to the lift system and configured to engage a corresponding alignment device coupled to the portion of the vibratory separator, wherein profiles of the alignment device and the corresponding alignment device are at least one selected from conical, frustoconical, tapered or curved, wherein the alignment device has a conical shape and the corresponding alignment device has a conical shape, or the apparatus further comprising a proximity sensor coupled to alignment device.

2. The apparatus of claim 1, wherein the lift system comprises an actuator and a lifting member.

3. The apparatus of claim 2, further comprising a proximity sensor coupled to the actuator.

4. The apparatus of claim 2, wherein the actuator is an electric actuator, a pneumatic actuator, or a hydraulic actuator.

5. The apparatus of claim 2, further comprising a bearing seal disposed around a portion of the lifting member between the lifting member and the lift housing.

6. The apparatus of claim 1, wherein the lift system comprises a piloted check valve.

7. A method comprising:

actuating an actuator and vertically extending a lifting member;

contacting an alignment device coupled to the lifting member with a corresponding alignment device coupled to a portion of a vibratory separator by vertically raising the alignment device into a receiving surface provided on a bottom surface of the corresponding alignment device; and raising the portion of the vibratory separator to provide access to a screen of the vibratory separator, wherein the contacting an alignment device with a corresponding alignment device comprises engaging a conical surface of the alignment device with a corresponding frustoconical surface of the corresponding alignment device.

8. The method of claim 7, further comprising removing a band clamp from the vibratory separator.

9. The method of claim 7, further comprising sensing the corresponding alignment device coupled to the vibratory separator with a proximity sensor coupled to the alignment device coupled to the lifting member.

10. The method of claim 7, further comprising sensing a location of the lifting member with a sensor disposed on the actuator.

11. The method of claim 7, further comprising sensing a position of a magnetic piston of the actuator with a sensor.

12. The method of claim 7, further comprising automatically turning off a vibration mechanism of the vibratory separator when the lifting member is extended.

13. An apparatus comprising:

a lift housing;

an actuator disposed in the lift housing, the actuator including a lifting member;

an alignment device coupled to the lifting member;

a sensor bracket or component; and a proximity sensor configured to sense a location of the sensor bracket or component, wherein either the proximity sensor is disposed on the actuator and the sensor bracket or component is disposed on the lifting member or the proximity sensor is disposed on the lifting member and the sensor bracket or component is disposed on the actuator.

14. The apparatus of claim 13, wherein the alignment device includes a tapered surface.

15. The apparatus of claim 13, wherein the actuator is one of a motorized linear actuator, a hydraulic cylinder, or a magnetic force actuator.

16. The apparatus of claim 13, further comprising a bearing seal coupled to the lift housing, the lifting member slidingly engaged with the bearing seal.

17. A method comprising:

actuating an actuator and vertically extending a lifting member;

contacting an alignment device coupled to the lifting member with a corresponding alignment device coupled to a portion of a vibratory separator by vertically raising the alignment device into a receiving surface provided on a bottom surface of the corresponding alignment device; and raising the portion of the vibratory separator to provide access to a screen of the vibratory separator, wherein the method further comprises at least one selected from:

sensing the corresponding alignment device coupled to the vibratory separator with a proximity sensor coupled to the alignment device coupled to the lifting member;

sensing a location of the lifting member with a sensor disposed on the actuator;

sensing a position of a magnetic piston of the actuator with a sensor; and automatically turning off a vibration mechanism of the vibratory separator when the lifting member is extended.

* * * * *